US010865611B2

(12) United States Patent
Anderson et al.

(10) Patent No.: US 10,865,611 B2
(45) Date of Patent: Dec. 15, 2020

(54) VERTICAL CUTTINGS DRYER

(71) Applicant: Elgin Separation Solutions Industrials, LLC, Stafford, TX (US)

(72) Inventors: Michael Rai Anderson, Houston, TX (US); Emad Tariq Babri, Katy, TX (US)

(73) Assignee: Elgin Separation Solutions Industrials, LLC, Stafford, TX (US)

( * ) Notice: Subject to any disclaimer, the term of this patent is extended or adjusted under 35 U.S.C. 154(b) by 0 days.

(21) Appl. No.: 15/582,303

(22) Filed: Apr. 28, 2017

(65) Prior Publication Data

US 2017/0314352 A1 Nov. 2, 2017

Related U.S. Application Data

(60) Provisional application No. 62/329,943, filed on Apr. 29, 2016.

(51) Int. Cl.

| | |
|---|---|
| ***E21B 21/06*** | (2006.01) |
| ***B04B 9/08*** | (2006.01) |
| ***B04B 3/04*** | (2006.01) |
| ***B04B 9/10*** | (2006.01) |
| ***B04B 1/20*** | (2006.01) |
| ***B04B 11/08*** | (2006.01) |

(52) U.S. Cl.

CPC ..... *E21B 21/065* (2013.01); *B04B 1/2016* (2013.01); *B04B 3/04* (2013.01); *B04B 9/08* (2013.01); *B04B 9/10* (2013.01); *B04B 11/08* (2013.01)

(58) Field of Classification Search

CPC ..... E21B 21/065; B04B 3/04; B04B 9/08; B04B 9/10; B04B 1/2016; B04B 11/08

See application file for complete search history.

(56) References Cited

U.S. PATENT DOCUMENTS

| | | | |
|---|---|---|---|
| 1,630,201 | A | 5/1927 | Metcalfe |
| 1,649,346 | A | 11/1927 | Grimble |

(Continued)

FOREIGN PATENT DOCUMENTS

| | | | |
|---|---|---|---|
| DE | 704643 | C | 4/1941 |
| WO | 2007112466 | A1 | 10/2007 |

OTHER PUBLICATIONS

International Patent Application No. PCT/US2017/030239, International Search Report and Written Opinion dated Aug. 13, 2017, 10 pages.

(Continued)

*Primary Examiner* — Liam Royce

(74) *Attorney, Agent, or Firm* — Fredrikson & Byron, P.A.

(57) ABSTRACT

A vertical cuttings dryer ("VCD") can be used to separate solid particulate from entrained liquid. In some examples, the VCD includes a screen mounted coaxially with an internal wiper housing that carriers a wiper sweeping out an annular space between the screen and wiper housing. The VCD may have a first motor connected through drive shaft to the screen and a second motor connect through a separate drive shaft to the wiper housing. A controller can independently control the speed of the first motor and the second motor to independently a magnitude of centrifugal force applied to material being processed as well as a residence time of the material being processed in the annular space.

12 Claims, 5 Drawing Sheets

(56) References Cited

U.S. PATENT DOCUMENTS

| | | | | |
|---|---|---|---|---|
| 1,756,194 | A | 4/1930 | Haug | |
| 2,370,353 | A * | 2/1945 | Howe | B04B 11/04 210/374 |
| 2,499,457 | A | 3/1950 | Buquoi et al. | |
| 2,550,971 | A | 5/1951 | Aldo | |
| 2,863,560 | A | 12/1958 | Gerhard et al. | |
| 2,886,179 | A | 5/1959 | Heckmann et al. | |
| 3,437,209 | A * | 4/1969 | Evans | B04B 1/20 210/374 |
| 3,851,819 | A * | 12/1974 | Tadokoro | B04B 9/08 494/8 |
| 4,141,837 | A | 2/1979 | Heckmann et al. | |
| 4,369,698 | A | 1/1983 | Hemfort et al. | |
| 4,369,915 | A | 1/1983 | Oberg et al. | |
| 4,432,747 | A | 2/1984 | Posse et al. | |
| 4,715,956 | A | 12/1987 | Heckmann et al. | |
| 4,978,331 | A | 12/1990 | Luchetta et al. | |
| 4,991,766 | A | 2/1991 | Hunnicutt, III et al. | |
| 5,494,584 | A | 2/1996 | McLachlan et al. | |
| 5,512,031 | A | 4/1996 | Ziems | |
| 5,857,955 | A | 1/1999 | Phillips et al. | |
| 5,879,279 | A | 3/1999 | Berger et al. | |
| 6,149,573 | A | 11/2000 | Berger et al. | |
| 6,368,264 | B1 | 4/2002 | Phillips et al. | |
| 6,507,161 | B2 | 1/2003 | Fair | |
| 6,763,605 | B2 | 7/2004 | Reddoch | |
| 6,860,845 | B1 | 3/2005 | Miller et al. | |
| 6,905,452 | B1 | 6/2005 | Kirsch | |
| 6,971,982 | B1 | 12/2005 | Kirsch | |
| 7,387,602 | B1 | 6/2008 | Kirsch | |
| 8,172,740 | B2 | 5/2012 | El Dorry et al. | |
| 8,961,381 | B2 | 2/2015 | Walraven et al. | |
| 9,283,572 | B2 | 3/2016 | Derrick et al. | |
| 2006/0014619 | A1 * | 1/2006 | Haider | B04B 1/2016 494/53 |
| 2006/0105896 | A1 | 5/2006 | Smith et al. | |
| 2007/0193055 | A1 | 8/2007 | Clarke et al. | |
| 2015/0072850 | A1 | 3/2015 | Derrick et al. | |
| 2016/0319615 | A1 | 11/2016 | Babri et al. | |

OTHER PUBLICATIONS

Anderson, "The Application of Waste Solids Management Vertical Cuttings Dryers as an Integral Element of a Successful Solids Control System," Elgin Separation Solutions, Revision B, 2015, 13 pages.

Anderson, "Understanding the Potential Class II—Division 1 Safety Hazards Present When Operating Vertical Cuttings Dryers," Elgin Separation Solutions, Revision D, 2015, 5 pages.

European Patent Application No. 17790591.6, Extended European Search Report dated Nov. 14, 2019, 8 pages.

* cited by examiner

VERTICAL CUTTINGS DRYER

RELATED APPLICATION

This application claims the benefit of U.S. Provisional Application Ser. No. 62/329,943, filed Apr. 29, 2016, the entire contents of which are incorporated herein by reference.

TECHNICAL FIELD

This disclosure relates to separation devices for processing solids-containing streams and, more particularly, to vertical cuttings dryer arrangements for processing solids-containing streams.

BACKGROUND

A vertical cuttings dryer ("VCD") is a separation device used in the drilling industry to separate drilling cuttings from entrained liquid. For example, in the oil industry, a VCD may be used separate expensive and environmentally sensitive drilling fluids from earthen drilling cuttings generated as the drill bit bores into the earth. In a typical application, drilling cuttings fluidized in drilling fluid are extracted from the well bore and transported to a flow line shaker system that performs a bulk separation between the drilling cuttings and drilling fluid. This can produce a stream of wet drilling cutting, for example, containing residual oil, water, and/or drilling fluid. To further separate the solid drilling cuttings from the entrained liquid, the drilling cuttings can be passed through a VCD to further separate the solid particulate matter from the entrained liquid.

In practice, the characteristics of the drilling cuttings stream processed on a VCD can vary widely. For example, the geology of the region where the drilling is occurring, the types of drilling fluids introduced into the well, and the configuration of the upstream processing units before the VCD can all impact the characteristics of the drilling cuttings stream received by the VCD. Having the ability to change the operating characteristics and performance of the VCD to address any changes in the drilling cuttings stream can provide operators with process control and flexibility to avoid process upsets and maximize recovery of fluids.

SUMMARY

In general, this disclosure is directed to a vertical cuttings dryer as well as techniques and systems incorporating such a vertical cuttings dryer. In some examples, the VCD includes a screen mounted coaxially with and outside of a wiper housing. For example, both the screen and wiper housing may be conically shaped and be separated from one another with an annular processing space between the components. In operation, both the screen and wiper housing can rotate to impart a centrifugal force to a stream being processed and affect a separation on the stream. For example, when used to process a drilling cuttings stream containing wet drill cuttings, the drilling cuttings stream may be introduced through an inlet opening at the top of the VCD into the annular processing space. The screen and wiper housing can both rotate to impart a centrifugal force to the drilling cuttings stream in the annular space. The wiper housing may rotate at a different speed than the screen to cause outwardly extending wiper blades to sweep through the annular space between the wiper housing and screen, helping to prevent plugging and pushing material vertically downwardly through the annular processing space. As the drilling cuttings stream is propelled through the VCD, entrained liquid can pass through the screen and discharge through one exit port while residual solid cuttings pass downwardly through the annular space and discharge through a different exit port, thereby separating liquid carried by the drilling cuttings from the solid cuttings themselves. Naturally, the VCD may be used to process other materials where separation between components is desired than wetted drilling cuttings.

In accordance with some examples of the present disclosure, the VCD is configured with two motors that independently drive rotational motion of the screen and the wiper housing. For example, one motor may be connected through a direct mechanical linkage of one or more rotatable shafts to the screen while the other motor is connected through a direct mechanical linkage of one or more rotatable shafts to the wiper housing. The speed of each motor can be varied independently to independently set the rate of rotation of the screen and wiper housing.

Configuring the VCD with two motors to independently drive the screen and wiper housing can be useful for a variety of reasons. As one example, the motors can allow the amount of force applied to the stream being processed to be varied independently of the residence time for the stream within the VCD. In general, the amount of centrifugal force imparted to stream being processed is dictated by the speed at which the screen rotates. By contrast, the residence time of the stream within the VCD, which is inversely related to throughput or processing rate on the VCD, is dictated by the speed differential between the screen and the wiper housing. Increasing the speed differential increases the rate at which material moves through the VCD and, correspondingly, decreases the residence time of the material in the VCD. Decreasing the speed differential decreases the rate at which material moves through the VCD and, correspondingly, increases the residence time of the material in the VCD.

By configuring the VCD to have two motors independently driving the screen and the wiper housing, the amount of force applied to the stream being processed and residence time of the stream within the VCD can be independently controlled. This can provide an operator with far more flexibility to set the processing characteristics on the VCD, for example to deal with challenging and varied feedstocks, than when using a VCD with a single motor driving the screen and wiper housing through a fixed gear ratio. Moreover, depending on the configuration of the VCD, the VCD may be configured with two motors that each have less than half the power draw (e.g., horsepower) of what would be required for a single motor VCD to process a similar stream. This can deliver immediate energy efficiency and cost benefits to the user. In applications where the VCD uses direct drive mechanical linkages to convey power from the two motors to the screen and wiper housing, respectively, high maintenance components such as active lubrication systems and belts can be eliminated to enhance the reliability of the device and reduce the maintenance burden.

In one example, a vertical cuttings dryer is described that includes a screen, a wiper housing, a first motor, and a second motor. The screen has an interior face and an exterior face. The wiper housing is positioned inside of the screen and mounted coaxially therewith, thereby defining an annular processing space between the interior face of the screen and an exterior surface of the wiper housing. The wiper housing carries at least one wiper configured to sweep through the annular processing space. The first motor is operatively connected to the screen and configured to drive rotation of the screen. The second motor is operatively connected to the wiper housing and configured to drive rotation of the wiper housing. The example specifies that the speed of the first motor is adjustable independently of a speed of the second motor so as to control both a magnitude of centrifugal force applied to material being processed in the annular processing space as well as a residence time of the material being processed in the annular processing space.

In another example, a method of operating a vertical cuttings dryer is described. The method includes introducing a material to be processed into an annular processing space formed between a screen and a wiper housing. The example specifies that the screen is mounted coaxially with the wiper housing and the wiper housing carries at least one wiper configured to sweep through the annular processing space. The method includes rotating the screen using a first motor operatively connected to the screen and rotating the wiper housing using a second motor operatively connected to the screen. The method further involves discharging material having passed through the screen through a first outlet and discharging residual material separated from the material having passed through the screen through a second outlet.

The details of one or more examples are set forth in the accompanying drawings and the description below. Other features, objects, and advantages will be apparent from the description and drawings, and from the claims.

DETAILED DESCRIPTION

This disclosure generally relates to a VCD with a screen and wiper housing that have independently adjustable rotational speeds. The rate of rotation of the screen and wiper housing can be independently controlled to adjust the magnitude of centrifugal force applied to the material being processed in the VCD as well as to control the amount of time the material being processed resides in the VCD. In general, increasing the amount of residence time in the VCD increases the amount of liquid separated from the solid material but reduces the throughput rate of the VCD.

In some examples, the VCD is configured with dual motors: one for driving the screen and one for driving the wiper housing. For example, the dual motors may be arranged in a vertically stacked arrangement (e.g., with one motor positioned vertically above the other motor), either at the same angular position about the perimeter of the VCD or at different angular positions. In either case, each motor may be mechanically coupled to a respective one of the screen and wiper housing through one or more drive shafts. For example, each motor may be coupled through a mechanical linkage that includes a generally horizontally oriented drive shaft, a gear box, and a vertically oriented drive shaft. Rotational motion generated by the motor can be translated through the mechanical linkage to a respective one of the screen and wiper housing, causing the screen and wiper housing to rotate. A VCD according to the disclosure can have a variety of features and configurations, as described in greater detail herein.

Figure 1:
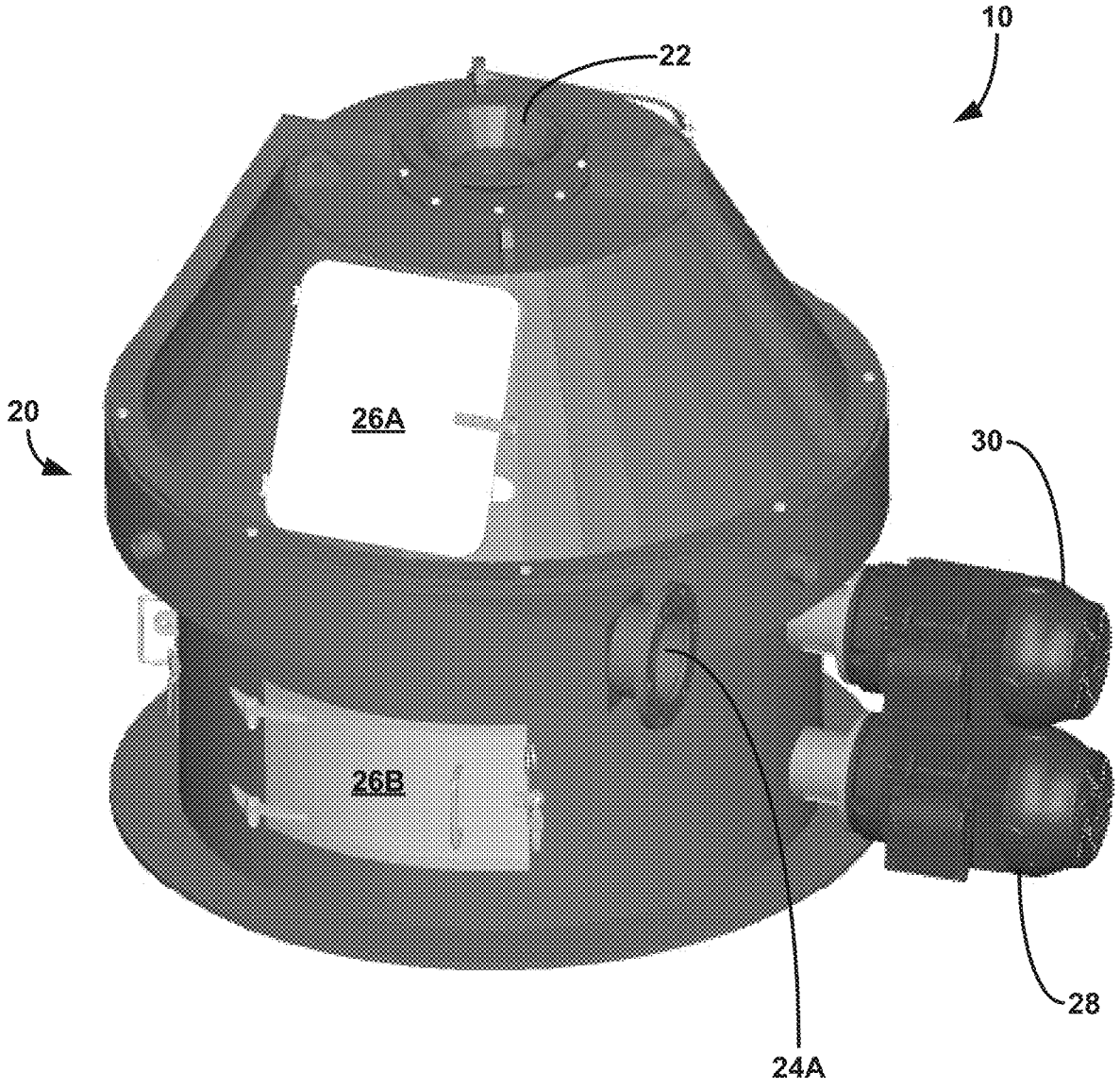
FIG. 1 is a perspective view of an example VCD according to the disclosure.
Figure 2:
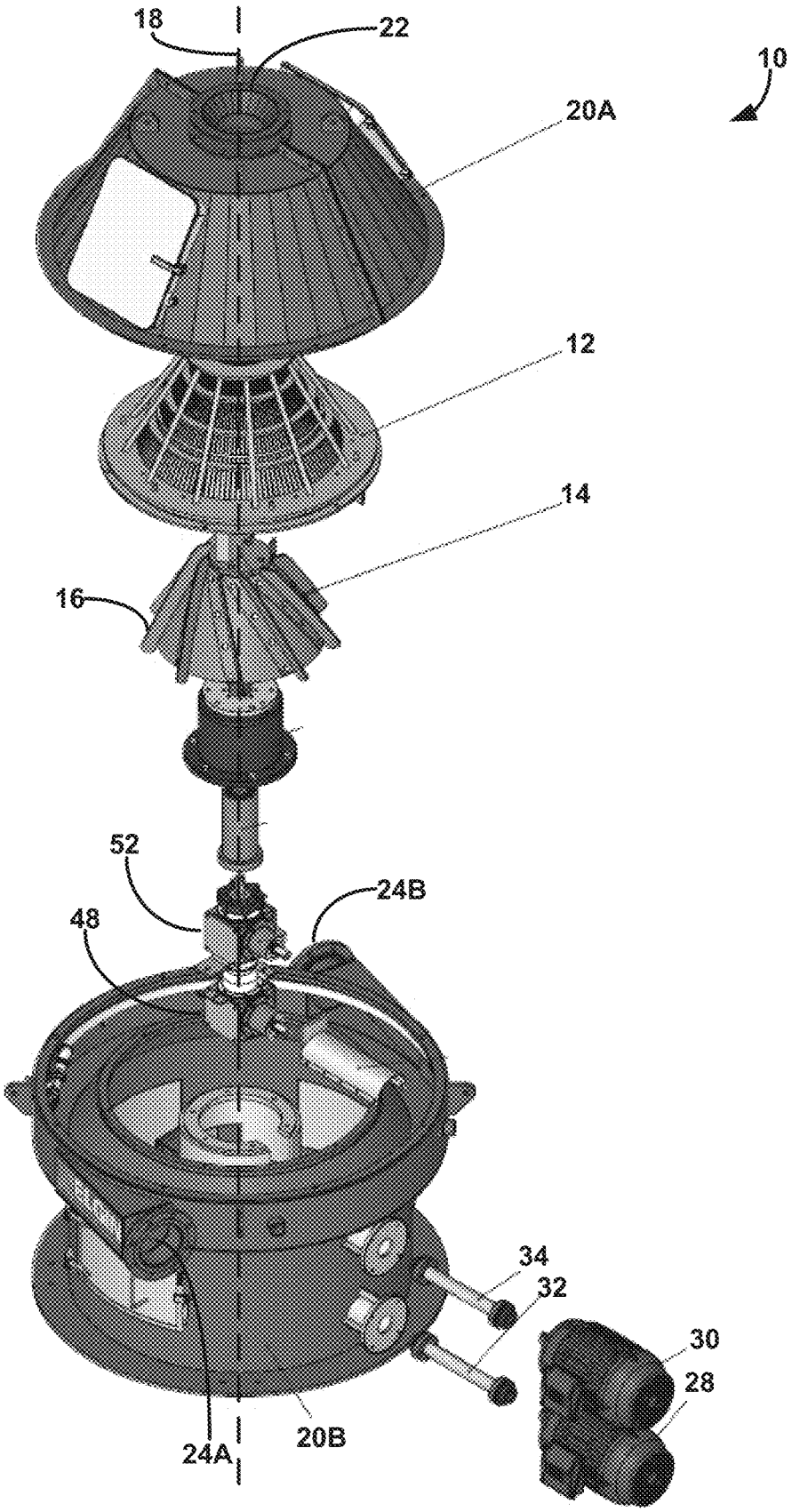
FIG. 2 is an exploded perspective view of the example VCD of FIG. 1.

FIGS. 1 and 2 are illustrations of an example VCD 10 according to the disclosure. FIG. 1 is a perspective view of VCD 10 showing the components of the VCD in an assembled arrangement. FIG. 2 is an exploded perspective view of VCD 10. As shown in the illustrated example, VCD 10 includes a screen 12 and a wiper housing 14. Wiper housing 14 carries at least one wiper 16, which is illustrated as a plurality of wipers positioned about the circumference of the wiper housing. When assembled, wiper housing 14 is positioned inside of screen 12 and mounted coaxially with the screen about an axis 18. In operation, screen 12 and wiper housing 14 can rotate, for example co-directionally but at different rates of rotation, to cause separation between different material components in the stream being processed.

The various components of VCD 10 are illustrated as being contained within a housing 20. Housing 20 is illustrated as being formed of a top cover 20A and a bottom housing section 20B (collectively "housing 20"). Top cover 20A can be positioned over an exterior facing surface of screen 12 and can bound material passing through screen 12 during operation of the VCD. Bottom housing section 20B can receive and hold various operational components of the VCD, such as drive shafts, gear boxes, mechanical couplings, and sensors. To introduce a material to be processed into VCD 10, housing 20 includes an inlet 22. Material passing through screen 12 can discharge from housing 20 through a first outlet 24A, while residual material not passing through the screen can discharge from the housing through a second outlet 24B. Top cover 20A may have an a hinged access door 26A and/or bottom housing section 20B may have a hinged access door 26B to provide access to the various components of the VCD, for example, for cleaning, maintenance, or repair.

To drive rotation of screen 12 and wiper housing 14 during operation of VCD 10, the VCD includes at least one motor, which in the illustrated configuration is shown as two motors: first motor 28 and second motor 30. The first motor 28 can be operatively connected to screen 12 such that power supplied by the motor translates through linkages to rotate the screen. The second motor 30 can be operatively connected to wiper housing 14 such that power supplied by the motor translates through linkages to rotate the wiper housing. In some configurations, first motor 28 and/or second motor 30 may be connected to a drive belt such that rotational energy supplied by the motor drives the belt which, in turn, drives a respective one of the screen and wiper housing. In other configurations, first motor 28 and/or second motor 30 may be directly coupled to a respective one of the screen and wiper housing through rigid shaft(s) and/or gears.

For instance, in the example of FIG. 2, VCD 10 is illustrated as including a first drive shaft 32 and a second drive shaft 34. The first drive shaft 32 engages with the first motor 28 and can supply energy from the motor for rotating screen 12. The second drive shaft 34 engages with the second motor 30 and can supply energy from the motor for rotating wiper housing 14. Such direct mechanical linkages can eliminate problems associated with belt breaking and belt maintenance. In addition, eliminating flexible belt linkages may reduce the footprint of housing 20 (e.g., by reducing the size of the tunnel needed to pass the linkage through the housing) and/or may allow VCD 10 to operate without an active lubrication system involving a lubricant pump and tank (e.g., as may otherwise be needed for a planetary gearbox associated with flexible belt linkages). That being said, alternative configurations may use other mechanical linkage arrangements than the drive shaft configuration illustrated, and the disclosure is not limited in this respect.

Figure 3:
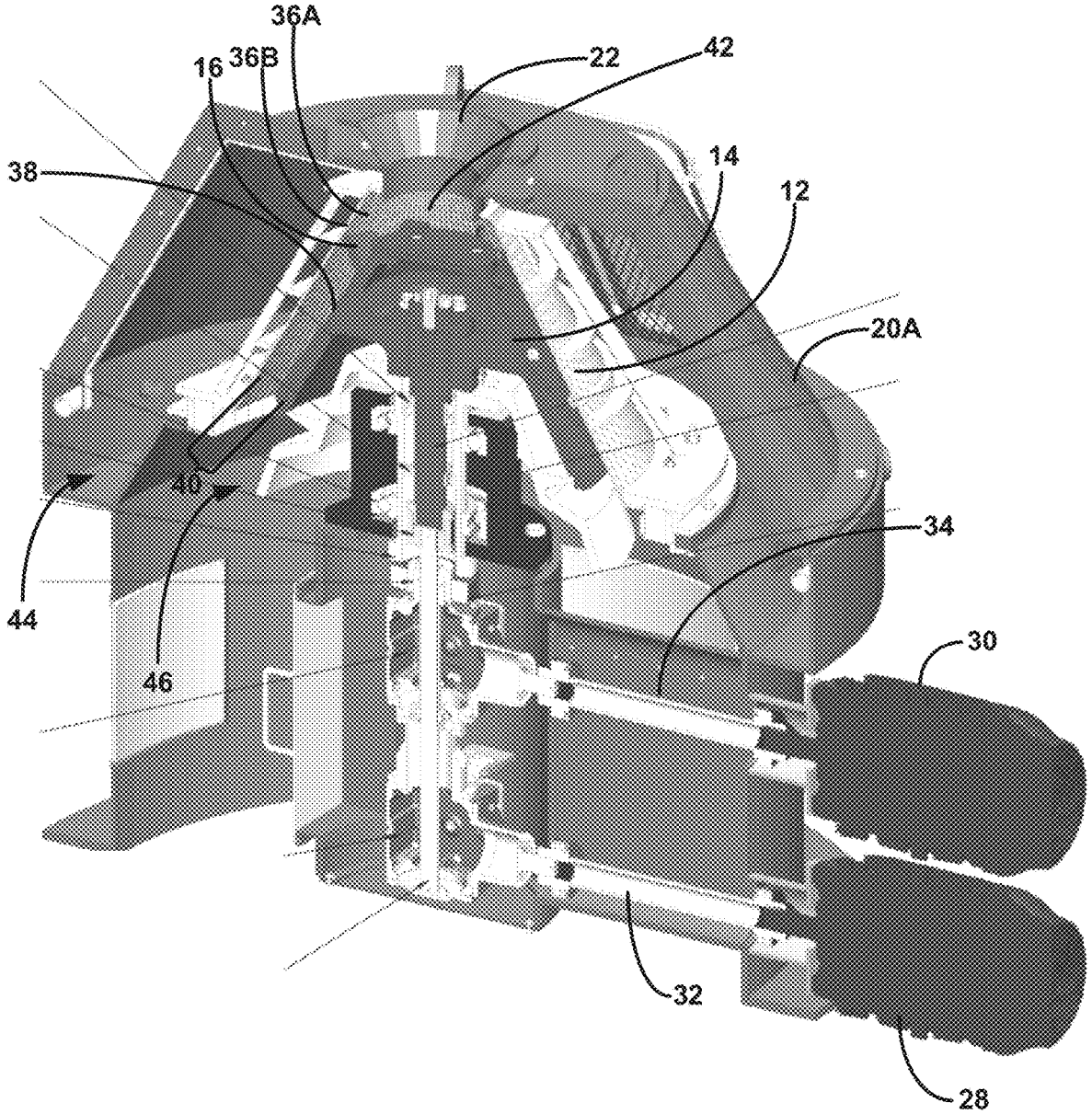
FIG. 3 is a cross-sectional view of the VCD of FIG. 1 showing an example configuration of the components for the VCD.

FIG. 3 is a cross-sectional view of VCD 10 from FIG. 1 showing an example configuration of the components for the VCD. As shown, screen 12 is positioned over a top side of wiper housing 14 inside of top cover 20A. Screen 12 has an interior facing surface 36A and an exterior facing surface 36B opposite the interior facing surface. The interior facing surface 36A of screen 12 faces toward an exterior surface 38 of the wiper housing 14 with an annular processing space 40 defined between the surfaces. The annular processing space 40 can have a size equal to or greater than the length the wiper blades project off of exterior surface 38 of wiper housing 14. For example, in some configurations, wiper 16 is sized relative to annular processing space 40 such that the wiper blades contacts the interior facing surface 36A of the screen as wiper housing rotates relative to screen 12.

In operation, incoming material to be processed can enter housing 20 through inlet 22 and enter into the annular processing space between screen 12 and wiper housing 14 through an opening 42 in the top of the screen. As screen 12 and wiper housing 14 rotate, the centrifugal force generated by rotation can distribute the incoming material radially outwardly against the interior surface 36A of screen 12. Wiper blades 16 extending radially outwardly from wiper housing 14 can drive the material being processed downwardly through the processing area of the VCD.

Material (e.g., liquid, smaller solids) within the stream being processed that is smaller than the apertures in the screen can pass through the screen from the interior side to the exterior side. Conversely, residual matter that does not pass through the screen (e.g., solid material larger than the apertures in the screen) can remain on the interior side of the screen. Wiper housing 14 may be devoid of apertures such material not passing though screen 12 remains bounded between the interior surface of the screen and the wiper housing before passing out of the annular processing space. In this way, VCD 10 can perform separation on a stream being processed based on size exclusion.

Material having passed through screen 12 can spread radially outwardly into a receiving channel 44 located radially outside of and below the screen. The receiving channel 44 can be in fluid communication with the first outlet 24A for discharging the material from housing 20. Residual material separated from the material passing through screen 12 can flow into separate receiving channel 46 located below annular processing space 40. The receiving channel 46 can be in fluid communication with the second outlet 24B for discharging the material from housing 20.

Figure 4:
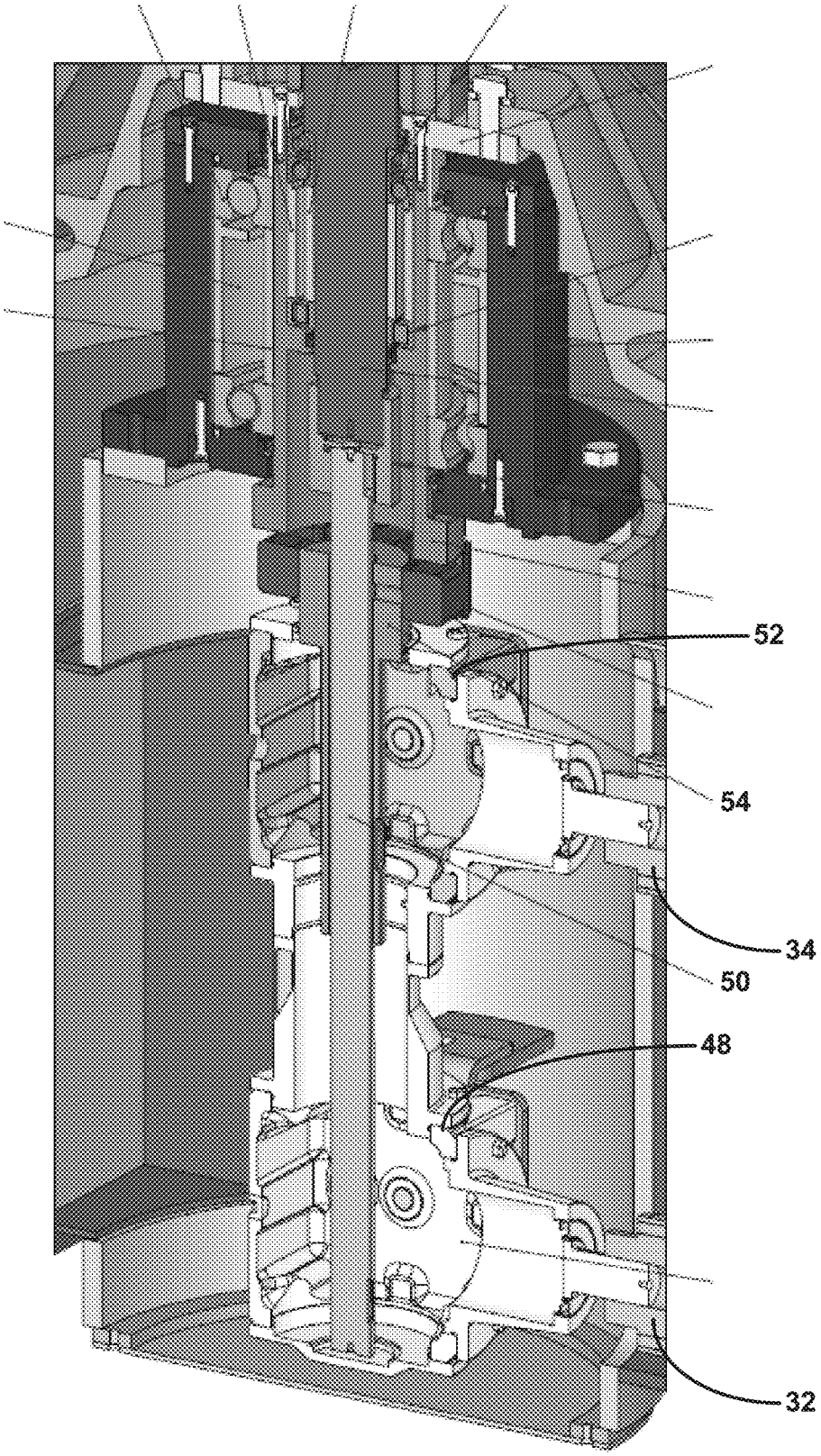
FIG. 4 a sectional view of a portion of the illustration of FIG. 3 highlighting an exemplary arrangement of features shown in the image.

As discussed above, VCD 10 can have a variety of different configurations to convey the rotational motion provided by first motor 28 and second motor 30 to screen 12 and wiper housing 14, respectively. In the configuration of FIG. 3, first motor 28 is connected through a mechanical linkage to screen 12, while second motor 30 is connected through a mechanical linkage to wiper housing 14. FIG. 4 a sectional view of a portion of the illustration of FIG. 3 to highlight an exemplary arrangement of features shown in the image.

As shown in the configuration of FIGS. 3 and 4, first motor 28 is connected to screen 12 through a mechanical linkage that includes first drive shaft 32, a first gear box 48, and a first vertically-oriented drive shaft 50. Second motor 30 is connected to wiper housing 14 through a mechanical linkage that includes second drive shaft 34, a second gear box 52, and a second vertically-oriented drive shaft 54. In operation, first motor 28 rotates causing rotation of first drive shaft 32. The rotational motion of first drive shaft 32 is translated through the first gear box 48, causing rotation of first vertically-oriented drive shaft 50. A terminal end of first vertically-oriented drive shaft 50 can be physically coupled (directly or indirectly) to screen 12 such that rotation of the first vertically-oriented shaft causes rotation of the screen. Second motor 30 also rotates during operation causing rotation of second drive shaft 34. The rotational motion of second drive shaft 34 is translated through the second gear box 52, causing rotation of second vertically-oriented drive shaft 54. A terminal end of second vertically-oriented drive shaft 54 can be physically coupled (directly or indirectly) to screen 12 such that rotation of the second vertically-oriented shaft causes rotation of the wiper housing.

First gear box 48 and second gear box 52 can each have a set of gears within a casing. The gear ratio for first gear box 48 and second gear box 52, which is the ratio of input speed relative to output speed, may range from 0.5/1 to 3/1, such as from 1/1 to 2/1, although other gear ratios can be used depending on particular application. The gear ratio of first gear box 48 may be the same as or different than second gear box 52.

In the illustrated configuration, first motor 28 and second motor 30 are arranged in a vertically stacked arrangement, e.g., such that one motor is at a higher vertical elevation than the other motor. This stacked arrangement can be useful to implement a dual-motor configuration without expanding the footprint of the VCD beyond that required for a one motor configuration. To transfer power from first motor 28 and second motor 30 in such a stacked arrangement, one of first vertically-oriented drive shaft 50 and second vertically-oriented drive shaft 54 can be a hollow cylinder with the other drive shaft (e.g., which may be a solid, non-hollow shaft) is positioned inside of and extending through the hollow cylinder. For example, in the configuration shown on FIG. 4, second vertically-oriented drive shaft 54 is configured as a hollow lumen with first vertically-oriented drive shaft 50 extending through the lumen (e.g., such that a terminal end of the first vertically-oriented drive shaft extends above the upper terminal end of the second vertically-oriented drive shaft). During operation, first vertically-oriented drive shaft 50 can rotate within second vertically-oriented drive shaft 54, e.g., as the second vertically-oriented drive shaft 54 rotates concentric with and about the first vertically-oriented drive shaft. Such a configuration can allow first motor 28 and second motor 30 to be vertically stacked yet also transfer power to screen 12 and wiper housing 14, which are also vertically stacked.

While FIGS. 3 and 4 illustrated one particular configuration of a direct drive linkage to transfer power from first motor 28 and second motor 30 to screen 12 and wiper housing 14, respectively, other configurations can be used. For example, mechanical linkages connecting first motor 28 to screen 12 and second motor 30 to wiper housing 14 may have fewer components (e.g., only a single shaft with or without gear box) or more components (e.g., more than two shafts interconnected together) than illustrated. As another example, instead of orienting the axis of rotation of first motor 28 and second motor 30 horizontally (e.g., perpendicular with the axis of rotation of screen 12 and wiper housing 14), the motors may be positioned vertically under the screen and wiper housing in alternative configurations.

In this examples, the axis of rotation of first motor 28 and second motor 30 can be parallel to (e.g., coaxial with) the axis of rotation of screen 12 and wiper housing 14.

Components described as motors, including first motor 28 and second motor 30 can be any machine that transform an input energy source into rotating mechanical energy. First motor 28 and second motor 30 may typically be implemented using electrical motors powered by an external electricity source (e.g., generator, mains power), although in appropriate applications (e.g., non-flammable applications) a combustion engine can be used as a motor for VCD 10. The power rating of first motor 28 and second motor 30 can vary, e.g., based on the size and throughput capacity of VCD 10. Further, first motor 28 and second motor 30 can have the same power rating or different power ratings. In some examples, first motor 28 and second motor 30 are each electrical motors having a size ranging from 20 horsepower to 100 horsepower, such as from 25 horsepower to 50 horsepower.

Configuring VCD 10 with at least two motors, one of which drives screen 12 and one of which drives wiper housing 14, can be useful so the speed at which the screen and the wiper housing rotates can be independently controlled. For example, first motor 28 and second motor 30 can each include a variable frequency drive (VFD) controller that is configured to vary the frequency and/or voltage supplied to the motor to adjust the speed at which the motor rotates. In use, an operator can set the speed at which screen 12 rotates (e.g., by setting the speed of first motor 28) and independently set the speed at which wiper housing 14 rotates (e.g., by setting the speed of second motor 30). In contrast to configurations where a single motor is connected to the screen and wiper housing through a gear box providing a fixed gear ratio, VCD 10 with two drive motors can provide a wide range of operating flexibility, leading to improved separation and operating efficiency.

Figure 5:
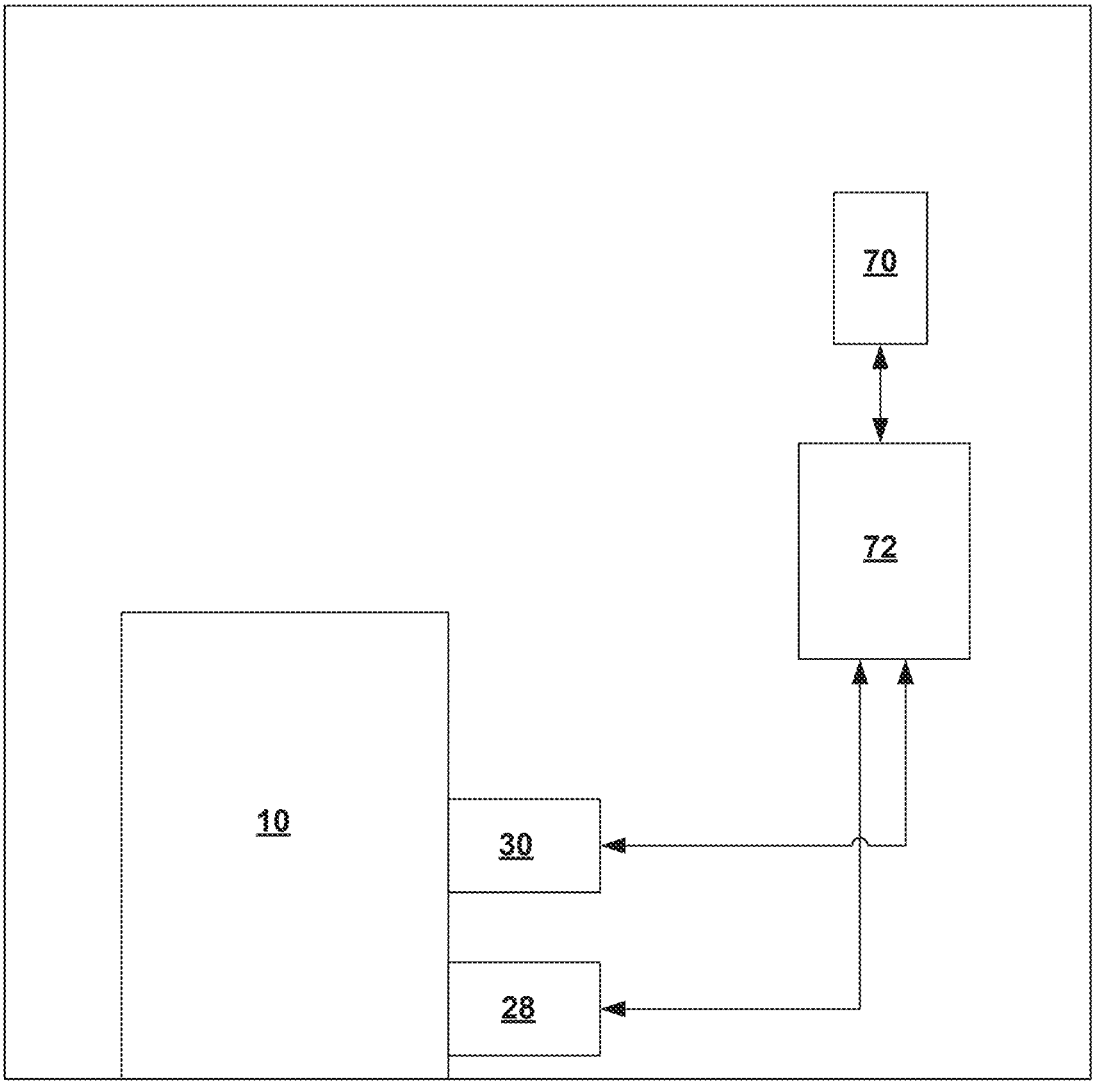
FIG. 5 is a block diagram showing an example control system for controlling the VCD of FIG. 1.

FIG. 5 is a block diagram showing an example control system that an operator can interface with to control the magnitude of centrifugal force applied to material being processed in the VCD as well as a residence time of the material in the VCD. As shown, the control system includes VCD 10, a user interface 70, and a controller 72. Controller 72 is communicatively coupled to first motor 28 and second motor 30 (e.g., a variable frequency drive of each motor) of VCD 10. User interface 70 may be any device that an operator can interact with to provide instructions and information to controller 72. In some examples, user interface 70 can also provide information back to the user from controller 72. User interface may be or include a button, switch, computer terminal, mobile phone or tablet, touch screen display, or other suitable interface. User interface 70 can communicate with controller 72 through wired or wireless connection.

Controller 72 can communicate with first motor 28 and second motor 30 through wired or wireless communication. In some examples, controller 72 controls other equipment in the facility where VCD 10 is used, such as a facility-wide PLC system. Controller 72 can include a processor and memory. The memory can store software for running the controller and may also store data generated or received by the processor, e.g., from one or more sensors on VCD 10. The processor can run software stored in the memory to manage the operation of VCD 10, including first motor 28 and second motor 30.

In operation, a user may interact with user interface 70 to indicate to controller 72 the speed at which screen 12 and wiper housing 14 should rotate. For example, the user may directly enter the desired operating speeds for the components or select the desired speeds from a menu of options. Alternatively, the user may input or select operating targets and/or parameters for VCD 10 specified not in terms of rotational speed but rather other processing parameters. For example, the user may enter or select the type of feed being processed, the characteristics of the feed (e.g., percent solids), and/or the desired characteristics of the discharge streams from the VCD. Such information may also be electronically communicated to controller 72 from other sources other than the user. In either case, controller 72 may determine the amount of power to deliver from first motor 28 and second motor 30 based on the received information, e.g., with reference to information stored in memory. Controller 72 may subsequently communicate with first motor 28 and second motor 30, for example by controlling a change in the frequency and/or voltage of power supplied to one or both motors, to control the speed of the first motor 28 and second motor 30.

As an example, controller 72 may receive a user input via user interface 70 indicating that the centrifugal force to be applied to the material being processed needs to be changed, e.g., based on the changing characteristics of the stream or desired separation efficiency achieved by VCD 10. In response to receiving the user input, controller 72 may control the voltage delivered to first motor 28 to adjust the speed at which the motor rotates and, correspondingly, the speed at which screen 12 rotates. Controller 72 can increase the speed to increase the amount of centrifugal force applied to the material being processed and decrease the speed to decrease the amount of centrifugal force applied to the material.

Additionally or alternatively, controller 72 may receive a user input via user interface 70 indicating that the residence time, or amount of time material being processed takes to pass through VCD 10, needs to be changed, e.g., based on the changing characteristics of the stream or desired separation efficiency achieved by VCD 10. In response to receiving the user input, controller 72 may control the voltage delivered to first motor 28 and/or second motor 30 to adjust the speed at which the first motor and/or second motor rotates. This can correspondingly adjust the speed at which screen 12 and/or wiper housing 14 rotates. Controller 72 may increase the speed of first motor 28 and/or decrease the speed of second motor 30, thereby increasing the differential rate of rotation between the screen and the wiper housing, to decrease the residence time of the material being processed in the VCD. Alternatively, controller 72 may decrease the speed of first motor 28 and/or increase the speed of second motor 30, thereby decreasing the differential rate of rotation between the screen and the wiper housing, to increase the residence time of the material being processed in the VCD.

The techniques described in this disclosure may be implemented, at least in part, in hardware, software, firmware or any combination thereof. For example, various aspects of the described techniques may be implemented within one or more processors, including one or more microprocessors, digital signal processors (DSPs), application specific integrated circuits (ASICs), field programmable gate arrays (FPGAs), or any other equivalent integrated or discrete logic circuitry, as well as any combinations of such components. The term "processor" and "controller" may generally refer to any of the foregoing logic circuitry, alone or in combination with other logic circuitry, or any other equivalent circuitry. A control unit comprising hardware may also perform one or more of the techniques of this disclosure.

Such hardware, software, and firmware may be implemented within the same device or within separate devices to support the various operations and functions described in this disclosure. In addition, any of the described units, modules or components may be implemented together or separately as discrete but interoperable logic devices. Depiction of different features as modules or units is intended to highlight different functional aspects and does not necessarily imply that such modules or units must be realized by separate hardware or software components. Rather, functionality associated with one or more modules or units may be performed by separate hardware or software components, or integrated within common or separate hardware or software components.

The techniques described in this disclosure may also be embodied or encoded in a non-transitory computer-readable medium, such as a computer-readable storage medium, containing instructions. Instructions embedded or encoded in a computer-readable storage medium may cause a programmable processor, or other processor, to perform the method, e.g., when the instructions are executed. Non-transitory computer readable storage media may include volatile and/or non-volatile memory forms including, e.g., random access memory (RAM), read only memory (ROM), programmable read only memory (PROM), erasable programmable read only memory (EPROM), electronically erasable programmable read only memory (EEPROM), flash memory, a hard disk, a CD-ROM, a floppy disk, a cassette, magnetic media, optical media, or other computer readable media.

Various examples have been described. These and other examples are within the scope of the following claims.

The invention claimed is:

1. A vertical cuttings dryer comprising:

a screen having an interior face and an exterior face;

a wiper housing positioned inside of the screen and mounted coaxially therewith, thereby defining an annular processing space between the interior face of the screen and an exterior surface of the wiper housing, the wiper housing carrying at least one wiper configured to sweep through the annular processing space;

a first motor operatively connected to the screen and configured to drive rotation of the screen;

a second motor operatively connected to the wiper housing and configured to drive rotation of the wiper housing;

a controller; and a user interface, wherein a speed of the first motor is adjustable independently of a speed of the second motor so as to control both a magnitude of centrifugal force applied to material being processed in the annular processing space as well as a residence time of the material being processed in the annular processing space, and the controller is configured to receive a user input via the user interface and, responsive to receiving the user input, set the speed of the first motor and set the speed of the second motor;

a first drive shaft mechanically connecting the first motor to the screen and a second drive shaft mechanically connecting the second motor to the wiper housing;

a first vertically-oriented drive shaft, a second vertically-oriented drive shaft, a first gear box, and a second gear box, wherein the screen is mounted to the first vertically-oriented drive shaft, the wiper housing is mounted to the second vertically-oriented drive shaft, the first drive shaft is mechanically connected to the first vertically-oriented drive shaft through the first gear box, and the second drive shaft is mechanically connected to the second vertically-oriented drive shaft through the second gear box.

2. The dryer of claim 1, wherein the first motor and the second motor are positioned in a vertically stacked arrangement, the first gear box and the second gear box are positioned in a vertically stacked arrangement, and one of the first vertically-oriented drive shaft and the second vertically-oriented drive shaft comprises a hollow shaft and the other of the first vertically-oriented drive shaft and the second vertically-oriented drive shaft is positioned inside of the hollow shaft.

3. The dryer of claim 2, wherein the first motor is positioned above the second motor, the first vertically-oriented drive shaft comprises the hollow shaft, and the second vertically-oriented shaft is positioned inside of the first vertically-oriented shaft.

4. The dryer of claim 1, wherein the screen is mounted on a terminal end of the first vertically-oriented drive shaft.

5. The dryer of claim 1, wherein the screen and the wiper housing each have a conical shape.

6. The dryer of claim 1, further comprising a housing defining an inlet, a first outlet, and a second outlet, wherein the inlet is configured to convey the material being processed through an opening in the top of the screen and into the annular processing space, the first outlet is located radially outside of and below the screen and is configured to convey matter having passed through the screen from the material being processed out of the dryer, and the second outlet is located below the annular processing space and is configured to convey residual matter separated from the matter passed through the screen out of the dryer.

7. The dryer of claim 1, wherein the at least one wiper comprises a plurality of wipers positioned about the circumference of the wiper housing, each of the plurality of wipers extending radially outwardly from the exterior surface of the wiper housing.

8. The dryer of claim 1, wherein the screen comprises apertures configured to allow some but not all of the material being processed to pass through the apertures, and the wiper housing is devoid of such apertures.

9. The dryer of claim 1, wherein the user input comprises an indication of the magnitude of centrifugal force to be applied to material being processed and the residence time of the material being processed in the annular processing space.

10. The dryer of claim 1, wherein the controller is configured to increase the magnitude of centrifugal force applied to the material being processed by increasing the speed of the first motor and thereby increase a rate of rotation of the screen.

11. The dryer of claim 10, wherein the controller is configured to:

control the speed of the first motor and the speed of the second motor such that the screen rotates faster than the wiper housing;

decrease the residence time of the material being processed in the annular processing space by increasing the speed of the first motor and decreasing the speed of the second motor, thereby increasing a differential rate of rotation between the screen and the wiper housing, and increase the residence time of the material being processed in the annular processing space by decreasing the speed of the first motor and increasing the speed of the second motor, thereby decreasing the differential rate of rotation between the screen and the wiper housing.

12. The dryer of claim 1, wherein the user input comprises an indication of at least one of a type of material being processed, a characteristic of the material being processed, and a target characteristic of a discharge stream from the vertical cuttings dryer.

* * * * *